United States Patent [19]

Gonwa et al.

[11] 4,328,696

[45] May 11, 1982

[54] METHOD AND APPARATUS FOR FORMING A HEAT SHIELD PLATE

[75] Inventors: Charles J. Gonwa, Palos Hills; Kenneth L. Baker, Winfield; Ronald A. Sieloff, South Elgin, all of Ill.

[73] Assignee: Maremont Corporation, Chicago, Ill.

[21] Appl. No.: 236,981

[22] Filed: Feb. 23, 1981

[51] Int. Cl.[3] ..... B21O 9/05

[52] U.S. Cl. ..... 72/389; 72/466

[58] Field of Search ..... 72/389, 386, 396, 465, 72/466, 401

[56] References Cited

U.S. PATENT DOCUMENTS

| | | | |
|---|---|---|---|
| 1,960,788 | 5/1934 | Maroto | 72/401 |
| 3,188,843 | 6/1965 | Romano | 72/466 X |
| 3,580,044 | 5/1971 | Voss | 72/466 |
| 3,727,449 | 4/1973 | Johnston | 72/389 |
| 4,206,629 | 6/1980 | Grimaldo | 72/389 |

*Primary Examiner*—Leon Gilden

*Attorney, Agent, or Firm*—Allegretti, Newitt, Witcoff & McAndrews, Ltd.

[57] ABSTRACT

A method of making a heat shield for an exhaust system tailpipe which comprises the steps of positioning a blank of sheet metal between a die having a forming surface of generally arcuately concave cross-sectional configuration which extends in a generally arcuately convex direction and a straight cylindrical body of elastomeric material having a longitudinal axis extending generally tangentially with respect to the arcuately convex direction of extent of the die forming surface, effecting an initial relative movement between the die and the cylindrical elastomeric body in a direction toward one another so as to compress a central portion of the sheet metal blank to a central portion of the die forming surface by a central portion of the exterior surface of the cylindrical elastomeric body while the latter is in a straight condition, and progressively flexing opposite end portions of the cylindrical elastomeric body in directions toward the end portions of the die forming surface so as to progressively compress the end portions of the sheet metal blank into conformed engagement with the die forming surface by the exterior surface of the elastomeric body and an apparatus for performing the method.

10 Claims, 7 Drawing Figures

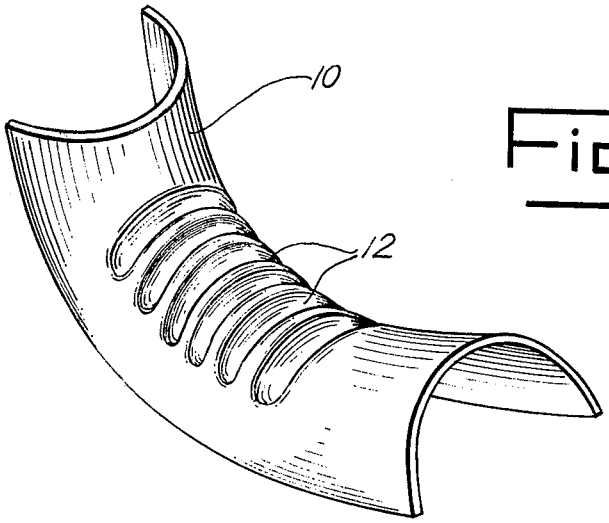
Fig. 1
Fig. 2
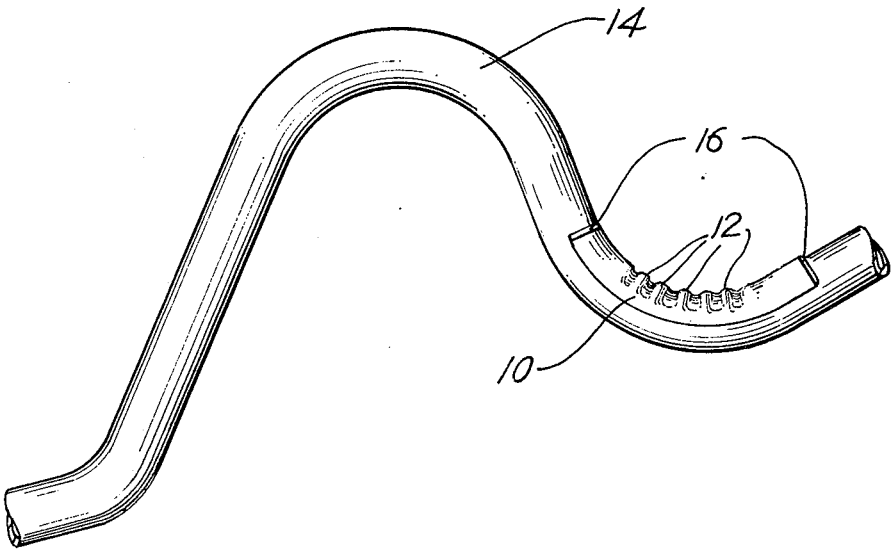

Fig. 5
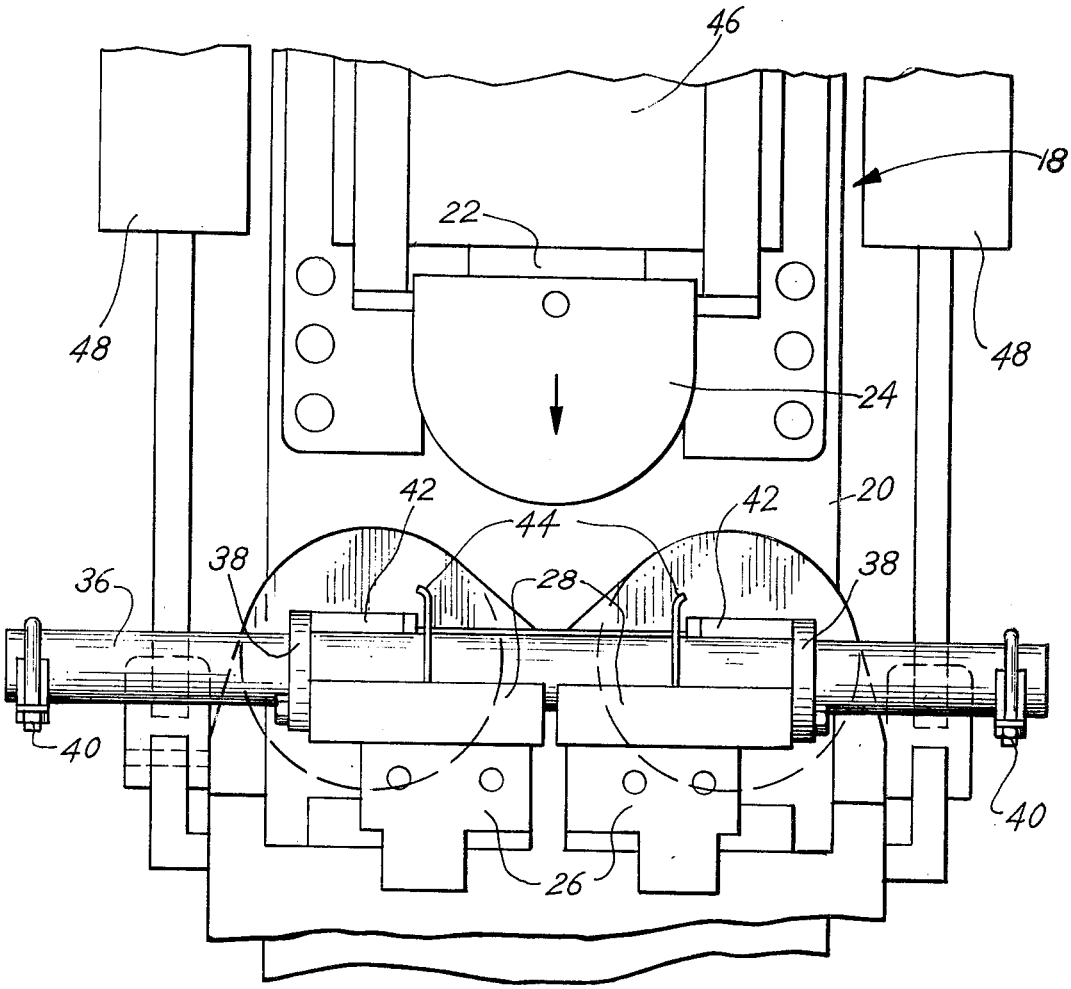
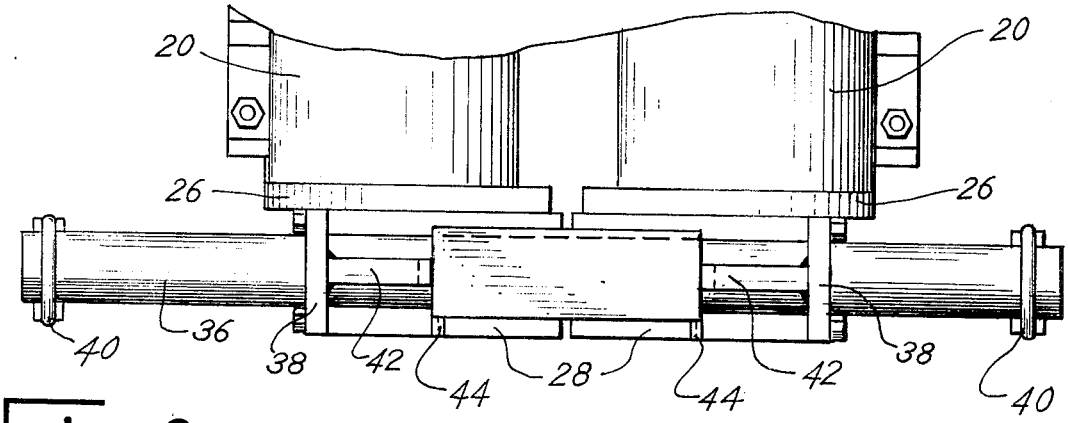
Fig. 6

METHOD AND APPARATUS FOR FORMING A HEAT SHIELD PLATE

This invention relates to heat shields for exhaust system pipes, and more particularly to an improved method and apparatus for making such heat shields.

In the exhaust systems utilized in some automotive vehicles the space provided for portions of the exhaust system tubing is extremely limited. In many instances it becomes necessary to position the tubing closely adjacent the metal which forms the vehicle floor. In order to prevent the vehicle floor from becoming too hot, it is necessary to provide a heat shield between the exhaust system pipe and the floor metal. The most economical manner of providing such a heat shield is to weld onto the exterior of the exhaust pipe a sheet metal plate which has been formed to fit the exterior configuration of the pipe and to provide the necessary heat shielding characteristics. A typical heat shield consists of a flat piece of sheet metal which has been arcuately bent in two directions. Usually deliberate corrugations are formed in the metal in order to control metal flow during the formation of the second curvature and to prevent uncontrolled wrinkling and folding.

Sheet metal heat shields of this configuration are readily manufactured by a stamping operation in which male and female dies are mounted in a press, a blank is inserted therebetween with the dies in an open condition and then the press is actuated to move the dies together and cause the metal to conform to the configuration of the male and female die surfaces. The stamp press male-female die method of manufacture is expensive because of the die costs and the wear characteristics of the die. It is an object of the present invention to provide an improved method and apparatus for forming dual curved heat shield plates which materially reduce the die formation and maintenance costs incident to metal stamping operations.

In accordance with the principles of the present invention, the method of the present invention utilizes as a basic apparatus component thereof a conventional tube bending machine which includes a vertically movable plunger having a die thereon for forming the interior of the pipe or tubing curvature and a pair of pivoting die members for forming the exterior of the tubing curvature. The present invention further contemplates the utilization of a straight cylindrical body of elastomeric material which is mounted in the two pivoted die members of the tube bending machine. Thus, with this simple modification of existing tube bending equipment, it becomes possible to form the dual curvature heat shield plate without the necessity of providing cooperating dies which must be accurately formed.

The method consists essentially of positioning a blank of sheet metal between a die having forming surface means of generally arcuately concave cross-sectional configuration which extends in a generally arcuately convex direction and a straight cylindrical body of elastomeric material having a longitudinal axis extending generally tangentially with respect to the arcuately convex direction of extent of the die forming surface means. Next, an initial relative movement is effected between the die and the cylindrical elastomeric body in a direction toward one another so as to compress a central portion of the sheet metal blank to a central portion of the die forming surface means by a central portion of the exterior surface of the cylindrical elastomeric body while the latter is in a straight condition. The final formation is completed by progressively flexing opposite end portions of the cylindrical elastomeric body in directions toward the end portion of the die forming surface means so as to progressively compress the end portions of the sheet metal blank into conformed engagement with the die forming surface means by the exterior surface of the elastomeric body. It can thus be seen that since the metal formation takes place by virtue of the compression of the metal between a rigid die and a body of elastomeric material, the need for accurate registry between cooperating fluid surface male and female dies is eliminated. By the same token, the wear incident to the utilization of such fixed surface dies is likewise eliminated.

Accordingly it is an object of the present invention to provide a method and apparatus for making a sheet metal heat shield of the type described which is simple but effective and economical in operation.

These and other objects of the present invention will become more apparent during the course of the following detailed description and appended claims.

The invention may best be understood with reference to the accompanying drawings, wherein an illustrative embodiment is shown.

In the drawings:

FIG. 1 is a perspective view of a heat shield formed by the method and apparatus embodying the principles of the present invention;

FIG. 2 is a view showing the heat shield assembled with a section of exhaust system tubing;

FIG. 5 is a fragmentary front elevational view of the heat shield forming apparatus which embodies the principles of the present invention, showing the position of the parts prior to the forming operation;

FIG. 6 is a fragmentary top plan view of the apparatus shown in FIG. 5.

Figure 7:
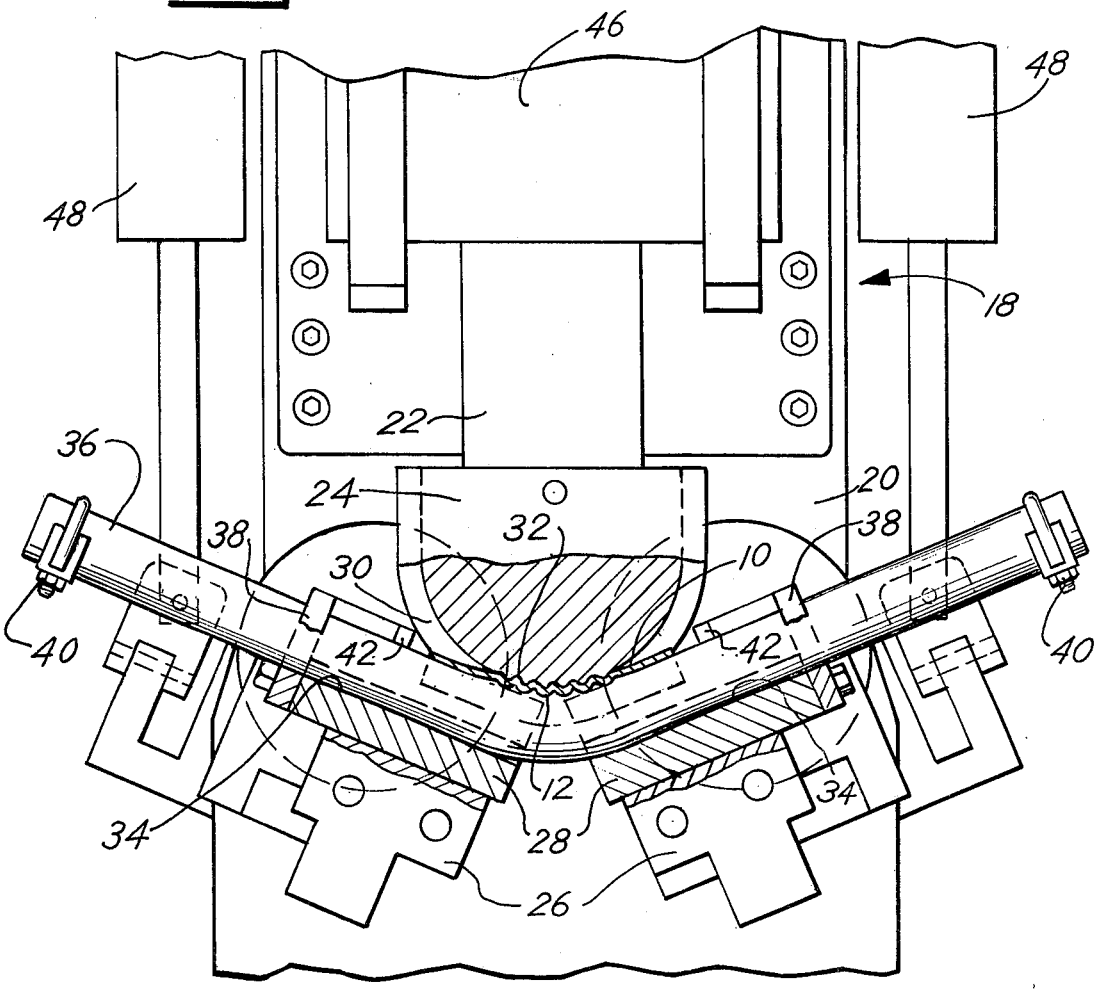
FIG. 7 is a view similar to FIG. 5 with certain parts broken away for purposes of clearer illustration, showing the position of the parts just prior to the completion of the forming operation.
Figure 3:
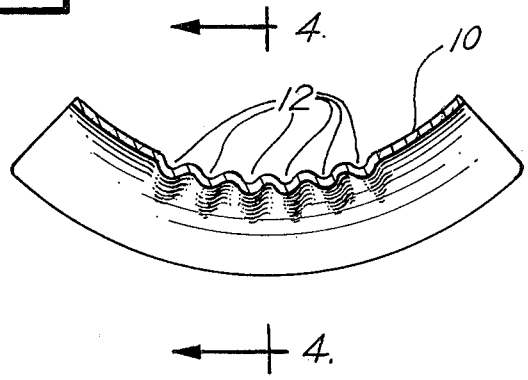
FIG. 3 is a vertical sectional view of the heat shield.
Figure 4:
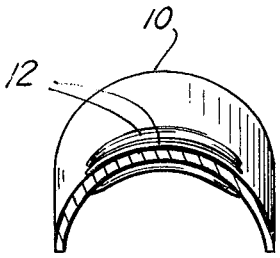
FIG. 4 is a sectional view of the heat shield taken along the line 4—4 of FIG. 3.

Referring now more particularly to the drawings, there is shown in FIGS. 1–4 one embodiment of a heat shield, generally indicated at 10, which can be formed by practicing the method of the present invention with the utilization of the apparatus of the present invention. As best shown in FIG. 1, heat shield 10 is formed from rectangular flat plate stock bent arcuately in two directions. The first arcuate bend is along an axis parallel with the length of the rectangular blank such that the cross-sectional configuration is arcuate with an angular extent of approximately 160°. The second arcuate bend is along an axis parallel with the width of the rectangular blank in a direction such that a radius line from the axis extends symmetrically through the arcuate cross-sectional configuration of the heat shield to the center of curvature thereof. The arcuate extent of the second arcuate bend is approximately 88°. Formed in the central portion of the heat shield is a series of corrugations 12. The corrugations 12 extend in the direction of the arcuate cross-sectional parallel with the width of the rectangular blank and perpendicular to the length thereof. Each corrugation is of arcuate cross-section with the concave side thereof facing toward the axis of the second arcuate curvature. Each corrugation 12 has a maximum arcuate curvature in cross-section at the central portion thereof and progressively decreases in curvature toward each end to zero curvature.

FIG. 2 illustrates a typical application of the heat shield 10 to a section of an exhaust system pipe 14. As shown, the pipe 14 is formed with an upwardly extending hump and the heat shield 10 is welded, as indicated at 16, to the upper exterior periphery of the pipe 14 where the downstream end of the hump appears.

The present invention is more particularly concerned with the provision of a simple but effective method and apparatus for producing the heat shield 10. The apparatus includes as its basic component a tube bending machine of any well-known type, an exemplary embodiment of which is illustrated somewhat schematically in the drawings and designated generally by the reference numeral 18. The machine 18 shown is model number 1900 manufactured by Teledyne-Pines, Inc., although it will be understood that other similar machines may be utilized as well. The machine 18 includes a base or frame 20 having an upper punch or head 22 mounted for vertical movement thereon which carries an upper die member 24. A pair of lower side-by-side pivoted members 26 which carry a pair of lower die members 28 are mounted on the base 20 for pivotal movement about parallel horizontal axes which are spaced apart a distance greater than the width of the upper die member 24.

The upper die member 24 is provided with a fixed die surface configuration, the main central portion of which mates with the concave side of the second arcuate curvature of the heat shield. Thus, the die surface presents a smoothly dual curved surface 30 having corrugations 32 formed therein. The smoothly curved surface 30 conforms with a surface generated by moving an arcuate line of approximately 180° arcuate extent arcuately through an angle of approximately 180° about a center, a radius line from which extends symmetrically through the arcuate line to the center thereof. The corrugations 32 extend in the direction of arcuate extent of the aforesaid arcuate line and are spaced apart in the direction of the aforesaid arcuate movement thereof. Each corrugation has a maximum arcuate curvature in cross-section at the central portion thereof and progressively decreases in curvature toward each end to zero curvature.

Each of the pair of die members 28 is formed with an upwardly facing smoothly curved die surface 34 of concave semi-cylindrical configuration. The radius size of each semi-cylindrical surface 34 is equal to the radius size of the aforesaid arcuately movable arcuate line defining the smoothly curved surface 30.

The apparatus of the present invention also includes as a main component thereof a straight cylindrical body 36 of elastomeric material. A preferred material is elastomeric polyurethane having a durometer of 80 A Duro hardness. The radius size of the cylindrical body 36 is such as to generally mate with the semi-cylindrical die surfaces 34 of the die members 28.

The elastomeric body 36 is mounted within the semi-cylindrical die surfaces 34 so as to provide for a limited amount of relative axial movement therebetween. To this end a ring retainer 38 is suitably fixed to the outer end of each die member 28. Each ring retainer has an interior periphery of a size to loosely receive the cylindrical body therethrough. In order to prevent the elastomeric body 36 from being accidently displaced from within the ring retainers 38 a clamp 40 is mounted on each end of the elastomeric body 36.

As best shown in FIGS. 5 and 6, the apparatus of the present invention also includes guide means for receiving and supporting a flat rectangular blank in a position between upper die member 24 and the cylindrical body 36 so that when the upper die member 24 is lowered the upper surface of the blank will be engaged by the die surfaces 30 and 34 of the die member and the lower surface of the blank will be engaged by the upper exterior periphery of the elastomeric body 36. As shown, such guide means includes a pair of blank end engaging guides 42 extending inwardly from the upper ends of the ring retainers 38 and a pair of forward guides 44 fixed to and extending upwardly from the die members 28.

It can be seen that when a rectangular flat blank of metal is positioned within the guide means in the manner depicted in FIGS. 5 and 6 and the pipe bending machine 18 is operated through its normal pipe bending cycle, the elastomeric body 36 will initially act as a straight convex semi-cylindrical die member in cooperation with the die member 24 as the latter descends, causing the flat blank to be initially bent between the two die surfaces into its arcuate cross-section. Further downward movement of the die member 24 results in the elastomeric body and arcuately bent blank being bent together in the manner of a pipe. FIG. 7 illustrates an intermediate position of bending. As shown, the member 22 is moved through its reciprocating cycle by a hydraulic cylinder 46. The pivoted members are pivotally moved by the movement of the member 22, such pivotal movement being controlled by controllably exhausting hydraulic cylinders 48.

It can thus be seen that after the blank has been properly positioned between the upper die member and elastomeric body, the operation of the machine will serve to form the heat shield by effecting an initial relative movement between the die and the cylindrical elastomeric body in a direction toward one another so as to comprise a central portion of the sheet metal blank to a central portion of the die forming surfaces by a central portion of the exterior surface of the cylindrical elastomeric body while the latter is in a straight condition, and by progressively flexing opposite end portions of the cylindrical elastomeric body in directions toward the end portions of the die forming surfaces so as to progressively compress the end portions of the sheet metal blank into conformed engagement with the die forming surfaces by the exterior surface of the elastomeric body.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A method of making a heat shield for use in an exhaust system which comprises the steps of:

positioning a blank of sheet metal between a die having forming surface means of generally arcuately concave cross-sectional configuration which extends in a generally arcuately convex direction and a straight cylindrical body of elastomeric material having a longitudinal axis extending generally tangentially with respect to the arcuately convex direction of extent of said die forming surface means, effecting an initial relative movement between said die and said cylindrical elastomeric body in a direction toward one another so as to compress a central portion of said sheet metal blank to a central portion of said die forming surface means by a central portion of the exterior surface of said cylindrical elastomeric body while the latter is in a straight condition, and progressively flexing opposite end portions of said cylindrical elastomeric body in directions toward the end portions of said die forming surface means so as to progressively compress the end portions of the sheet metal blank into conformed engagement with said die forming surface means by the exterior surface of said elastomeric body.

2. A method as defined in claim 1 wherein said die forming surface means comprises a smoothly curved surface having corrugations formed therein, said smoothly curved surface conforming with a surface generated by moving an arcuate line of approximately 180° arcuate extent arcuately through an angle of approximately 180° about a center a radius line from which extends symmetrically through the arcuate line to the center thereof, said corrugations extending in the direction of arcuate extent of the aforesaid arcuate line and being spaced apart in the direction of arcuate movement thereof.

3. A method as defined in claim 2 wherein each of said corrugations has a maximum curvature in cross-section at the central portion thereof and progressively decreases in curvature toward each end to zero curvature.

4. A method as defined in claim 1, 2 or 3 wherein said elastomeric material is polyurethane.

5. A method as defined in claim 4 wherein said elastomeric body has a durometer of 80 A Duro hardness.

6. In a pipe bending apparatus including a reciprocatingly movable member carrying a first die member and a pair of pivoted members mounted for pivotal movement about parallel axes perpendicular to the direction of reciprocating movement of said first member, said pair of pivoted members carrying second and third die members, said second and third die members having concave semi-cylindrical die surfaces disposed in an initial position of pivotal movement with their axes aligned and extending perpendicular to the pivotal axes of said pivoted members, said first die member having forming surface means of generally arcuately concave cross-sectional configuration which extends in a generally arcuately convex direction, the improvement which comprises a straight cylindrical elastomeric body of a size to engage within said semi-cylindrical die surfaces, means for retaining said elastomeric body therein for relative axial movement with respect thereto and guide means for retaining and supporting a rectangular flat blank in operative position between said die surface means of said first die member and the adjacent exterior periphery of said elastomeric body whereby the normal pipe bending movements of said members serve to form the rectangular flat blank into a heat shield.

7. The improvement as defined in claim 6 wherein said die forming surface means comprises a smoothly curved surface having corrugations formed therein, said smoothly curved surface conforming with a surface generated by moving an arcuate line of approximately 180° arcuate extent arcuately through an angle of approximately 180° about a center a radius line from which extends symmetrically through the arcuate line to the center thereof, said corrugations extending in the direction of arcuate extent of the aforesaid arcuate line and being spaced apart in the direction of arcuate movement thereof.

8. The improvement as defined in claim 7 wherein each of said corrugations has a maximum curvature in cross-section at the central portion thereof and progressively decreases in curvature toward each end to zero curvature.

9. The improvement as defined in claim 6, 7 or 8 wherein said elastomeric material is polyurethane.

10. The improvement as defined in claim 9 wherein said elastomeric body has a durometer of 80 A Duro hardness.

* * * * *